US005431797A

United States Patent [19]

Harvey

[11] Patent Number: 5,431,797

[45] Date of Patent: * Jul. 11, 1995

[54] ELECTROLYTIC-CATALYTIC-ELECTRO-CHEMICAL SERIES POTENTIAL CELL FOR IMPROVING COMBUSTION OF OXYGENATED HYDROCARBON FUELS

[75] Inventor: Draper M. Harvey, Hingham, Mass.

[73] Assignees: Academy of Applied Science; Rines and Rines, both of Concord, N.H. ; a part interest to each

[ * ] Notice: The portion of the term of this patent subsequent to Nov. 6, 2007 has been disclaimed.

[21] Appl. No.: 78,987

[22] Filed: Jun. 16, 1993

[51] Int. Cl.[6] ..... C25B 9/00

[52] U.S. Cl. ..... 204/272; 204/292; 204/290 R

[58] Field of Search ..... 204/131, 222, 242, 272, 204/280, 292, 101, 130, 131, 212, 157.15, 157.52, 157.44, 290 R, 294; 429/17, 27, 68, 94; 123/538

[56] References Cited

U.S. PATENT DOCUMENTS 4,968,396 11/1990 Harvey ..... 204/131
5,154,807 10/1992 Harvey ..... 204/131

*Primary Examiner*—Kathryn Gorgos
*Attorney, Agent, or Firm*—Rines and Rines

[57] ABSTRACT

An improved electrolytic-catalytic-electrochemical series potential cell for immersion in the fuel tank of diesel and gasoline engines to effect fuel modification prior to combustion, conducive to improved combustion with attendant increased fuel efficiency and reduced deletereous emissions, using a cylindrical zinc anode carrying a tightly wound helical noble metal (preferably silver-surfaced) winding, the terminal turns of which are rendered resilient to clip over and establish spring contact with the transverse ends of the anode cylinder to insure continuous electrochemical series potential generation irrespective of wear in use and resulting gaps developed between the winding and the cylindrical anode. Preferred metals for optimum cell operation for each of diesel and gasoline fuels are presented.

10 Claims, 1 Drawing Sheet

ELECTROLYTIC-CATALYTIC-ELECTROCHEMICAL SERIES POTENTIAL CELL FOR IMPROVING COMBUSTION OF OXYGENATED HYDROCARBON FUELS

The present invention relates to the improvement of combustion of oxygenated hydrocarbon fuels, as, for example, gasoline and diesel engine fuels, to reduce noxious environmentally undersirable by-products (CO, nitrogen and sulfur oxides, hydrocarbon particulates, etc.) and improve fuel efficiency; being more particularly directed to improvements in electrolytic-catalytic-electrochemical series potential cells, immersible in the fuel along with entrapped oxygen and water to modify the chemical structure thereof prior to combustion thereby, to achieve such end—the modification being attributed, at least in part, to the scavanging action of hydroxyl ion and/or hydrogen oxide formation by the cell-induced catalytic action as the fuel from the fuel tank passes therethrough.

BACKGROUND OF INVENTION

Such cells are described in my earlier U.S. Pat. Nos. 4,968,396 and 5,154,807, which have been found admirably to reduce exhaust by-products and improve fuel efficiency, as therein described in detail. While such cells have been found useful in vehicle and other diesel engines, as well as gasoline engines, the current direction of fuel refiners in changing the fuel chemistry, hopefully to improve the reduction of undesired by-products in the exhaust and/or improved mileage, and further experience particularly with diesel fuel operations, have now led to the discovery of significant improvements in cell construction. It is, accordingly, to such improved electrolytic-catalytic-electrochemical series potential cells, including optimum selection of fuel-reacting cell metals, particularly though not exclusively, for diesel fuel operation, that the present invention is directed.

OBJECT OF INVENTION

An object of the invention, accordingly, is to provide a new and improved electrolytic-catalytic-electrochemical series potential cell of the above-described character that accomodates for new composition gasoline and diesel fuels, and provides increased by-product elimination and fuel mileage efficiency particularly, though not only, with diesel fuels.

Other and further objects will be explained hereinafter and are more particularly delineated in the appended claims.

SUMMARY

In summary, from one of its viewpoints, the invention embraces an electrolytic-catalytic cell for immersion in a hydrocarbon fuel having, in combination, a longitudinally extending cylindrical metal anode element around which a helical cathode winding of a different metal in the electrochemical potential series is fixedly wrapped in contact with the anodic cylinder to generate electrochemical series fractional to few-volt potentials within the fuel, the said different metal being a noble metal of catalytic properties; and the terminal portions of the winding being formed into resilient clips engaging the transverse ends of the cylindrical anode element with spring retention to insure continuous electrochemical series potential generation irrespective of wear and gaps developed between the winding and the cylindrical anode element.

Preferred and best mode improved cell constructions and designs are hereinafter presented.

DRAWINGS

The invention will now be described with reference to the accompanying drawings.

FIG. 1 of which is a longitudinal cross-sectional view of an improved cell constructed in accordance with the invention; and FIG. 2 is a transverse section taken along the line A—A of FIG. 1, looking in the direction of the arrows.

DESCRIPTION OF PREFERRED EMBODIMENT OF INVENTION

Figure 1:
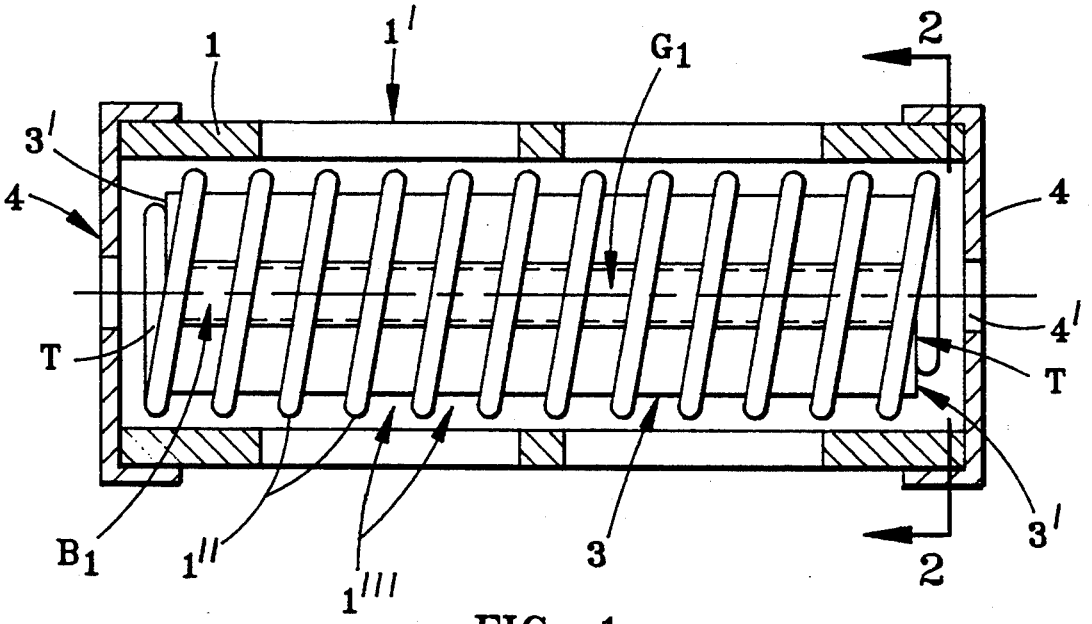

Referring to FIG. 1, a cell of the type described in my said earlier U.S. Patents is shown, particularly having the general construction of the embodiments of FIGS. 3A–3C of U.S. Pat. No. 5,154,807, embodying an outer cylindrical tubular metal housing 1, longitudinally apertured or slotted with openings 1' to permit the entrance and circulation of the fuel therewithin. A cylindrical pure zinc rod 3, somewhat smaller in length than the housing 1 and serving as the cell anode, extends loosely movable within the metal end caps 4 of the housing 1, such end caps being provided with openings 4'.

Wrapped or wound about, upon and in electrochemical series potential-generating fixed or static contact with the zinc anode 3, is a helical noble catalytic metal surface cathode winding 1'', providing open areas 1''' between successive windings that permit direct contact of the inner anode 3 with the fuel. As described more particularly in my said U.S. Pat. No. 5,154,807, such electrochemical series potentials are of the order of from fractional to few volts potential only; and in conjunction with proper metal part selection, enable the electrolytic-catalytic operation of the cell in its modification of the tank fuel with entrapped oxygen and water for the beneficial purposes of the invention.

Figure 2:
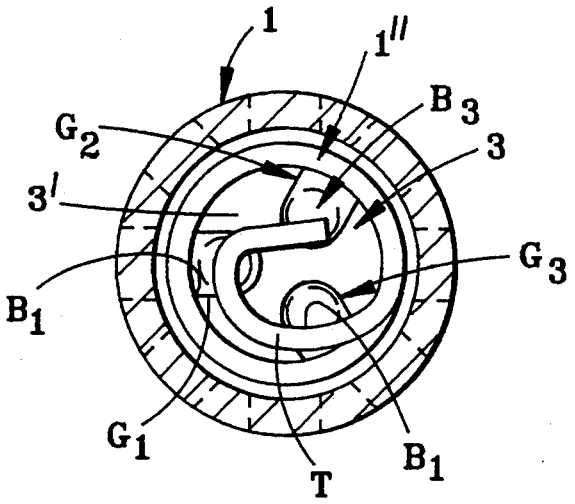

As further described in my said U.S. Pat. No. 5,154,807, the zinc anode rod 3 is provided with longintudinal circumferentially spaced grooves $G_1$, $G_2$, $G_3$, (preferably spaced 120°), shown as squared grooves in FIG. 2, each receiving an appropriate later-described metal bar ($B_1$, $B_2$, $B_3$) press-fitted and recessed within the corresponding groove to provide a spacing or clearance from the groove openings (say of the order of 1/32") so that the bars do not physically touch the cathode windings 1''.

It has been found that in use, erosion of particularly the zinc anode 3 can take place producing gaps between the fixed cathodic windings 1'' and the surface of the zinc cylindrical anode 3. To insure continued adequate electromotive series potential-generating effects between the anode and cathode, the present invention employs novel terminal winding turns on sections T that, are made springy, resiliently to apply pressure on the opposite end surfaces 3' of the anodic rod 3, providing spring-like retaining and assured continuous contact with the end surfaces 3' irrespective of wear, within the limits of practical useage over several years.

Turning, now, to the critical metal part selection for the electrolytic-catalytic and electro-chemical series potential operation for different type fuels, as described in my said prior U.S. Pat. No. 5,154,807, the cathode winding 1'', fixedly wrapped around the zinc anode 3, is a bronze wire plated with silver, as the preferred noble metal, with the terminal retaining clips T resiliently sprung against the anode end surfaces 3' in accordance with the improvement of the present invention. The outer slotted housing or cage 1 and end caps 4, which are preferably permanently attached thereto, are of mild carbon steel—but optionally modified to carry a tin plating which has now been found not only beneficially to resist corrosion of the steel, particularly in diesel fuel, but synergistically to keep down microbial and fungal growths in the fuel and its tank.

With diesel fuels, it has now been found that the most effective catalytic activity yet attained with cells of this type occurs with the use of both a rod of platinum, say $B_1$ in groove $G_1$, of platinum, and a rod of palladium $B_2$, (the preferred platinum-family noble metals), in groove $G_2$ and a mild carbon steel rod in the remaining open groove.

In addition to significant exhaust by-product reduction, as documented in my prior patents and incorporated herein by reference, it has startlingly been discovered that the improved cell above-described has attained rather an amazing degree of diesel fuel economies. Specifically, in tests supervised by the applicant and later independent verification tests by a state-approved testing agency, over 20% improvement in diesel fuel consumption has consistently been observed after about 90 hours of vehicle use with the cell of the present invention immersed in the fuel tank. Operational efficiency requires one cell for each 50 gallons in the fuel tank. Two such controlled tests (before and after cell immersion) by said agency were carried out for a 1985 Ford F250 truck with a 6.9 liter diesel engine (International) with 70,064 miles of use (Test Vehicle 1), and a 1992 Dodge one ton truck with a 5.9 liter diesel engine (Cummings) and a mileage of 13,729 miles (Test Vehicle 2).

TABLE 1

| TEST DATA SUMMARY | TEST VEHICLE | | |
|---|---|---|---|
| | 1 | 2 | AVERAGE |
| Miles driving | | | |
| (Before) | 89.5 mi | 86.1 mi | 87.8 mi |
| (After) | 89.6 mi | 86.1 mi | 87.8 mi |
| Fuel used | | | |
| (Before) | 5.2 gal | 4.25 gal | 4.73 gal |
| (After) | 4.3 gal | 3.5 gal | 3.9 gal |
| Fuel Economy (MPG) | | | |
| (Before) | 17.21 | 20.26 | 18.74 |
| (After) | 20.84 | 24.6 | 22.72 |
| Change in % | +21.1% | +21.4 | +21.24 |

With the improved structure of the cell of the present invention, the by-product emission reduction and improved fuel efficiency reported in my prior patents for gasoline vehicles has also been consistently attained. For the improved structure of FIGS. 1 and 2 and spectrum of current gasoline fuels, it has been found that rods $B_1$, and $B_3$ are again preferably of platinum and an unplated carbon steel third insert.

Further assistance, as described in my later before-referenced patent, is provided through use of bronze as the foundation metal, plated with palladium or platinum for the rods and with silver for the bronze cathodic spring. It has also been noted that platinum and silver on the winding of the cathodic element also serve to hold down microbial growths.

It has further been found that an optimal spacing for the synergism of electrolytic-catalytic activity, electrochemical series potential generation, and manufacturing practicality resides in the cathodic helical winding 1'' having a tighter successive turn winding than in my earlier patent, and a smaller spacing of the order of one-eighth of an inch between successive turns; for example, about 20 turns over a 3" anode rod 3 (about ½" in diameter) for diesel operation—and about 12 (11½) turns over a 2" anode 3 for automotive gasoline vehicle tanks, and about 8 turns over about a 1½" anode for similar smaller gasoline engines.

Further modifications will occur to those skilled in this art, and such are considered to fall within the spirit and scope of the invention as defined in the appended claims.

What is claimed is:

1. An electrolytic-catalytic cell for immersion in a hydrocarbon fuel having, in combination, a cylindrical metal anode element longitudinally extending between opposite transverse ends and around which a helical cathode winding having terminal portions and different metal in the electrochemical potential series is fixedly wrapped in contact with the anodic cylinder to generate electrochemical series fractional to few-volt potentials within the fuel, the said different metal being a noble metal of catalytic properties; and the terminal portions of the winding being formed into resilient clips engaging the transverse ends of the cylindrical anode element with spring retention to insure continuous electrochemical series potential generation irrespective of wear in use and resulting gaps developed between the winding and the cylindrical anode element.

2. An electrolytic-catalytic cell as claimed in claim 1 and in which the anode metal is of zinc and the cathode winding has a silver surface.

3. An electrolytic-catalytic cell as claimed in claim 2 and in which the anode with its helical cathode winding is contained loosely within an apertured carbon steel housing.

4. An electrolytic-catalytic cell as claimed in claim 2 and in which the spacing between the successive turns of the cathode winding is of the order of ⅛ inch.

5. An electrolytic-catalytic cell as claimed in claim 2 and in which cylindrical anode is provided with longitudinal grooves containing noble metal rod inserts received therein and with clearance so that the inserts do not touch the turns of the helical winding wound about the anode.

6. An electrolytic-catalytic cell as claimed in claim 5 for use with diesel fuels and in which one groove in the anode cylinder contains a platinum insert; another groove, a palladium insert; and a third groove, a carbon steel element.

7. An electrolytic-catalytic cell as claimed in claim 6 and in which the anode cylinder is about three inches in length and one-half of an inch in diameter, and the cathode winding comprises about 20 turns.

8. An electrolytic-catalytic cell as claimed in claim 5 for use with gasoline fuels and in which two grooves contain a platinum plated insert and a third groove a carbon steel insert.

9. An electrolytic-catalytic cell as claimed in claim 8 and in which the anode cylinder is from about 1 to ½–2 inches in length, one-half of an inch in diameter, and the cathode winding respectively comprises from about 8 to 12 turns, with grooves to hold two platinum and one mild carbon steel rods.

10. An improved electrolytic-catalytic-electrochemical series potential cell for immersion in the fuel of diesal and gasoline engines to effect fuel modification prior to combustion, conducive to improved combustion with attendant incresed fuel efficiency and reduced deletereous emissions, using a cylindrical zinc anode longitudinally extending between transverse ends and carrying a tightly wound helical noble metal winding provided with terminal turns, the terminal turns being rendered resilient to clip over and establish spring contact with the transverse ends of the anode cylinder to insure continuous electrochemical series potential generation irrespective of wear in use and resulting gaps developed between the winding and the cylindrical anode.

* * * * *